US006234668B1

(12) United States Patent
Cooper

(10) Patent No.: US 6,234,668 B1
(45) Date of Patent: May 22, 2001

(54) HOLDER FOR SECURING A TIMEPIECE TO AN ARTICLE

(75) Inventor: Martin R. Cooper, Cincinnati, OH (US)

(73) Assignee: Cooper & Company, Inc., Cincinnati, OH (US)

( * ) Notice: Subject to any disclaimer, the term of this patent is extended or adjusted under 35 U.S.C. 154(b) by 0 days.

(21) Appl. No.: 09/150,940

(22) Filed: Sep. 10, 1998

(51) Int. Cl.[7] ..... G04B 37/00; A44C 5/00

(52) U.S. Cl. ..... 368/281; 368/283; 368/286; 224/164; 224/171

(58) Field of Search ..... 368/88, 276, 278, 368/283, 286; 224/164, 168, 171, 177

(56) References Cited

U.S. PATENT DOCUMENTS

| | | | | |
|---|---|---|---|---|
| D. 402,104 | | 12/1998 | Kauker et al. . | |
| 2,511,105 | * | 6/1950 | Fenyvessy . | |
| 4,103,808 | * | 8/1978 | Hallman et al. | 224/168 |
| 4,155,219 | * | 5/1979 | Anderson | 368/283 |
| 4,511,261 | * | 4/1985 | Mishima | 368/286 |
| 4,769,799 | * | 9/1988 | Matsukage | 368/278 |
| 5,332,135 | * | 7/1994 | Fletcher | 368/283 |
| 5,540,367 | | 7/1996 | Kauker . | |
| 5,848,030 | * | 12/1998 | Sullivan | 368/282 |

* cited by examiner

*Primary Examiner*—Vit Miska
(74) *Attorney, Agent, or Firm*—Dinsmore & Shohl LLP

(57) ABSTRACT

A holder for securing a timepiece to an article, such as a backpack, tent, bicycle, or ski coat for example. In a preferred embodiment, the holder comprises a base which is securable to a watch case, and a cover to shield the watch case when it is attached to the base. In one embodiment, the watch case is secured to the base by an elastic strap which is of a width and thickness to fit between the pins of the watch case and the body of the watch case. The cover can comprise a flexible band which is movable from an open position to a closed position, and which can be locked in the closed position. Rings may be provided at opposing ends of the base to connect the base to an article. A belt may be fed through the rings to assist in connecting the holder to the article.

17 Claims, 5 Drawing Sheets

HOLDER FOR SECURING A TIMEPIECE TO AN ARTICLE

TECHNICAL FIELD

This invention relates to a holder for protecting a timepiece, and for selectively securing a timepiece to an article, and, more specifically, in a preferred embodiment, to a holder for securely mounting a wristwatch case to an article, such as a backpack or ski coat for example, which includes a protective cover to shield and protect the case when the case is attached to the holder, and which can accommodate a variety of watch cases.

BACKGROUND OF THE INVENTION

A wristwatch typically includes a watch case and a watch band for securing the watch case to the wrist of the user. Generally, the watch case includes a watch body which contains the moving watch parts (such as the hands) a face side for displaying the time, and a rear side for facing the wrist of the user. Typically, the watch case also includes opposite ends which generally support a pair of pins which are connected to the watch body for engaging bores in the watch band and/or otherwise securing the watch band to the watch case.

It has been found that in some circumstances and for some activities, wearing the wristwatch on the wrist can become cumbersome and uncomfortable, especially during strenuous activities such as backpacking and hiking. In addition, it has been found that wristwatches can be inadvertently left behind during preparation for a trip, class, meeting, or other event. Accordingly, it is desirable to have a watch attached to a personal belonging which is carried with the person during daily activities or which is carried on a trip or vacation. For example, a hiker may wish to have a watch attached to his or her backpack to avoid the discomfort associated with wearing a watch during strenuous activity, as well as to avoid the damage to the watch due to perspiration. Similarly, a student may wish to have a wristwatch attached to a school bag or school backpack such that a watch will always be available during the school day, even if the student does not remember or desire to wear a wristwatch during the day. Likewise, a business person may wish to attach a wristwatch to a piece of luggage such that a watch will be continually available during the various trips taken by the business person.

It is also desirable to be able to attach a watch easily and securely to other articles as well. For example, a camper may wish to hang a wristwatch from the ceiling of a tent. In addition, a biker may wish to securely attach a watch to the handlebars of a bike. Similarly, one may wish to attach a watch to the rear view mirror or dashboard of a vehicle.

While it has been known to attach a wristwatch to an article, such as a backpack, by attaching the band of the watch to the article, such a solution is not without disadvantages. First, due to the limited length and/or the limited number of locking positions of the band, the wristwatch typically will not fit tightly about the article and, accordingly, can easily catch on other items during travel thereby breaking the watch band or causing damage to the watch case. In addition, merely attaching the watch band to the article does not provide any protection for the wristwatch, and leaves it vulnerable to the daily wear and tear, as well as extraneous impacts, contacts and exposures associated with transporting the article. Moreover, there are many articles to which a watch band cannot be easily secured.

Accordingly, it is desirable to provide a timepiece holder which can be securely and easily fastened to a variety of articles, such as backpacks or bicycles for example. In addition, it is desirable to provide such a holder which can protect the timepiece from forces which may be encountered during transportation.

It has also been found that a person will often have one or more old or "worn out" watches which, while still functional, have an unattractive appearance and are not desirable to be worn on the wrist. Such watches may be more suitable for attachment to an article such as a backpack, ski coat, tent, bicycle, or duffel bag. Accordingly, it is further desired to provide a watch holder which can accommodate a number of watch types and sizes which a person may have on hand.

It has also been found that it can be difficult to access a watch worn on the wrist during cold-weather activities, such as skiing for example. During such activities, the wristwatch is typically covered by layers of clothing, gloves and a coat, and, accordingly, accessing the watch to read the time can be difficult and time consuming. Accordingly it is desirable to provide a watch holder which can be attached to or about bulky clothing, such as a ski coat for example.

SUMMARY OF THE INVENTION

Accordingly, it is an object of the present invention to obviate the above-described problems.

It is another object of the present invention to provide a timepiece holder which can be easily and securely attached to an article, such as a backpack, piece of luggage, bicycle, or tent.

Another object of the present invention is to provide a timepiece holder which can be secured to an article and which has a low profile when so secured, thereby minimizing the risk of snagging or catching other items during travel.

Yet another object of the invention is to provide a watch holder which can be secured to a portable article and which can also protect the watch case.

It is another object of the present invention to provide a protective watch holder which can attach to an article and which can accommodate a variety of watch cases.

Another object of the invention is to provide a protective watch holder which can be easily attached to a variety of items, such as to tents and bulky clothing, for example.

Additional objects and advantages of the invention will be set forth in the description that follows.

To achieve the foregoing and other objects, and in accordance with the purposes of the present invention as described above, a protective holder for a timepiece is provided. In this aspect of the invention, the holder comprises a base, a strap attached to the base, and a cover attached to the base. The strap is adapted to secure the timepiece to the base. At least a part of the cover can be selectively moved between an open position in which visual access to the timepiece is provided, and a closed position in which at least a portion of the timepiece is shielded. Preferably, the strap is elastic and the cover comprises a flexible band. It is also preferred that an attachment mechanism, such as a ring for example, is provided for attaching the holder to an article.

In another aspect of the invention, a method of attaching a watch case to an article is provided. The watch case includes a face and a rear, and the method comprises attaching the watch case to a base having a back side and a front side such that the rear of the watch case faces toward the front side of the base. The method also comprises attaching the base to the article such that the back side of the base faces toward the article, and attaching a protective cover to the base. Moreover, the method comprises moving the protective cover from an open position to a closed position such that the protective cover covers at least a portion of the face of the watch case.

In another aspect, a holder for securing a watch case to an article is provided. The holder comprises a base having a front side and a back side, an attachment mechanism attached to the base, a securement mechanism, and a watch case having a face and a rear. The attachment mechanism is adapted to connect the base to the article. The watch case is secured on the front side of the base by the securement mechanism such that the face of the watch case faces away from the front side of the base and the rear faces toward the front side of the base. Preferably, the securement mechanism comprises a strap, the base comprises a generally flat base, and the attachment mechanism comprises a ring. It is also preferred that a cover is attached to the base and is movable between an open position and a closed position.

Still other aspects of the present invention will become apparent to those skilled in this art from the following description wherein there is shown and described preferred embodiments of this invention, simply by way of illustration, as well as a best mode contemplated for carrying out the invention. As will be realized, the invention is capable of other different aspects and embodiments without departing from the scope of the invention. Accordingly, the drawings and descriptions should be regarded as illustrated in nature and not as restrictive in nature.

BRIEF DESCRIPTION OF THE DRAWINGS

While the specification concludes with claims particularly pointing out and distinctly claiming the invention, it is believed that the same will be better understood from the following description taken in conjunction with the accompanying drawings in which:

DETAILED DESCRIPTION OF THE PREFERRED EMBODIMENTS

Figure 2:
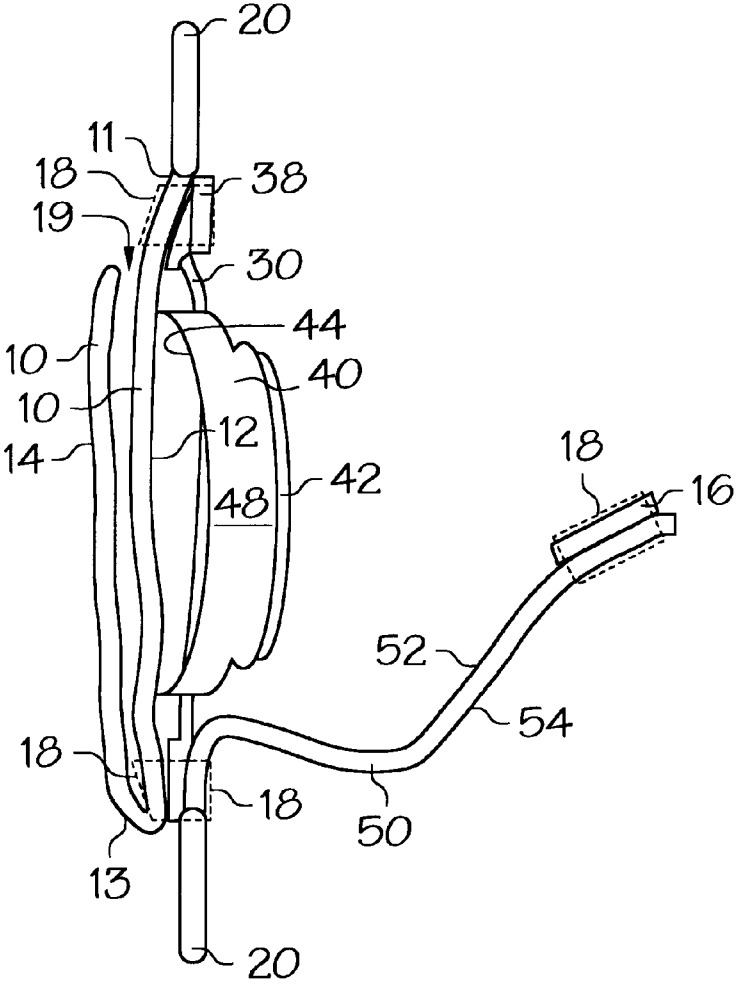
FIG. 2 is a side view of the holder and watch case of FIG. 1.
Figure 3:
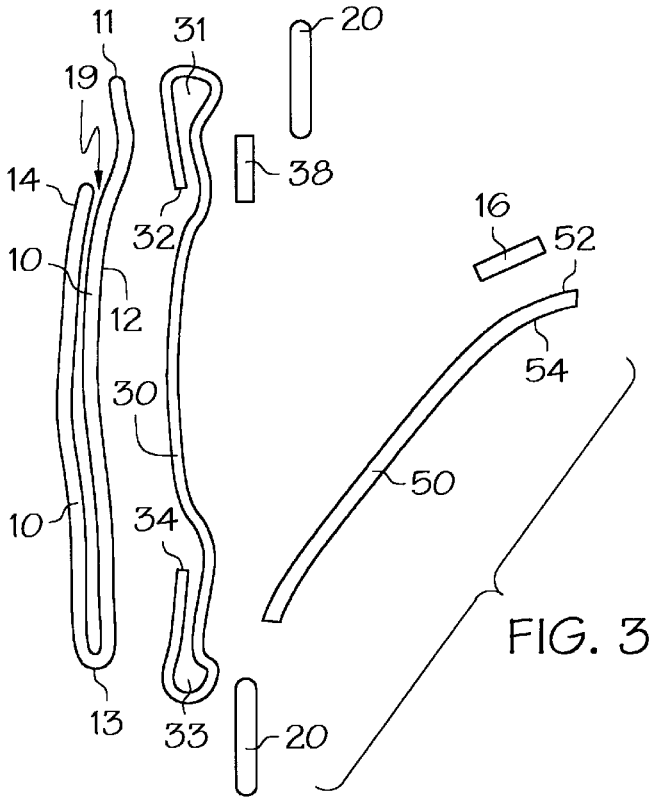
FIG. 3 is an exploded side view of the watch holder of FIG. 1.

Referring now to the drawings in detail, FIGS. 1–5 illustrate a first exemplary embodiment of a timepiece holder made in accordance with the present invention. As best shown in FIG. 3, this embodiment of the timepiece holder comprises a base 10 having a front side 12 and a back side 14, a flexible and preferably elastic strap 30 for securing the watch case to the base, a pair of D-rings 20 for connecting the holder to an article, and a flexible band 50 for shielding the face of the watch case when the watch case is attached to the front side of the base by the elastic strap.

The base 10 preferably comprises a generally flat patch of leather or other durable material so that the other components of the holder can be easily stitched to the base. The base 10 is also preferably flexible, resilient, and moisture resistant, so as to easily mount to an article and to resist wear and tear during daily activities. It is contemplated that a variety of materials could be utilized to form the base 10, such as leather, nylon, canvas, plastic, a variety of fibers (e.g., carbon fiber), cloths and cloth-like materials, and a variety of synthetic materials. In one preferred embodiment, a nylon webbing of about 40 millimeters in width is used. Preferably, the base 10 has a length of less than about 5 inches, a width of less than about 4 inches, and a thickness of less than about 0.4 inches. Even more preferably, the base 10 has a length of less than about 4 inches, a width of less than about 3 inches, and a thickness of less than about 0.2 inches.

In the exemplary embodiment of FIGS. 1–5, the base 10 includes a pocket 19 formed between the back side 14 and the front side 12 of the base. Such a pocket allows the base 10 to be additionally used for holding any variety of articles, such as coins, keys, medication, and/or cards for example. The storage pocket can be formed by folding the base 10 upon itself and securing the portions together along two of the sides, such as by using stitches 18 or adhesive for example. Alternatively, the pocket could be formed by securing two pieces together along three sides. The storage pocket could also include a closure or cover (not shown) that might snap open/closed for holding loose items securely.

Figure 1:
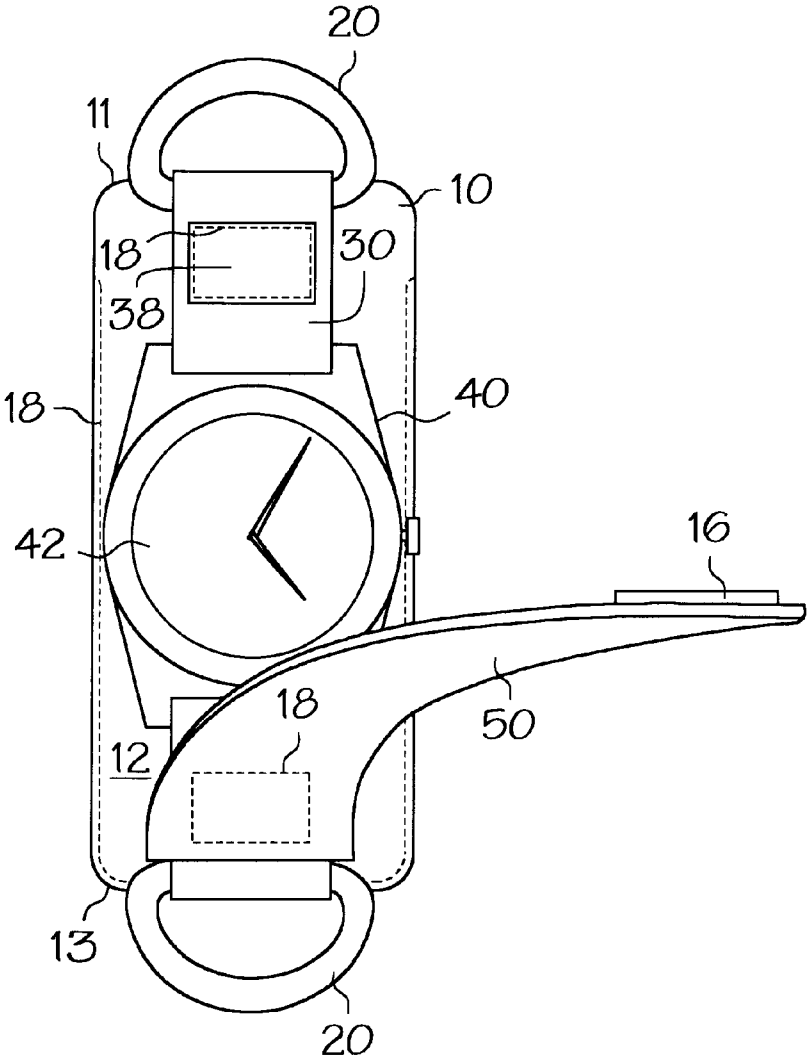
FIG. 1 is a front view of an exemplary embodiment of a watch holder made in accordance with the present invention, and shown in conjunction with a watch case which is secured to the holder by the strap of the holder, the protective cover of the holder being shown in an open position.
Figure 5:
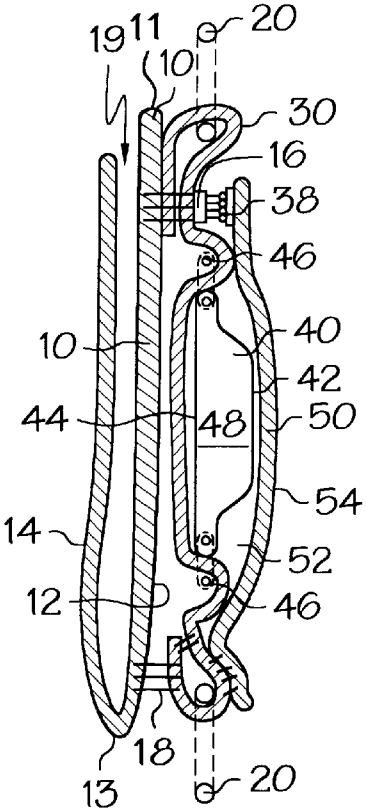
FIG. 5 is a cross sectional view of the holder and watch case shown in FIG. 1, taken along the longitudinal centerline of the holder and illustrating the protective cover in a closed position.

Attached to the base 10, is a strap 30 which serves as a securement mechanism for securing the watch case 40 to the base 10, as best shown in the preferred embodiment of FIG. 1, FIG. 2, and FIG. 5. The strap 30 preferably extends along the length of the base 10 and is attached near oppositely disposed ends 11 and 13 of the base. As best shown in FIG. 2, stitching 18 is provided near the first end 11 of the base 10 to secure the elastic strap 30 to the base. On the opposite end of the base 10, near a second end 13, it is preferred that the base 10 is secured to the strap 30 by stitching 18. However, it is contemplated that a variety of other means of attaching the elastic strap 30 to the base 10 can be utilized, such as adhesives, rivets, buttons, "hook and loop" style connectors, and other connectors. As is best shown in FIG.

2, attaching the strap 30 to the base 10 near the ends 11 and 13 of the base allows the watch case 40 to be placed on and secured to the unattached middle portion of the strap, thereby securing the watch case to the base.

The strap 30 preferably comprises a flexible and elastic fabric, to facilitate the connection of the watch case 40 to the base 10, the process of which is described in further detail below. A variety of materials can be used to form the strap 30 such as nylons, natural and synthetic leathers, fibers, cloths, fabrics, and other materials. In one preferred embodiment, an elastic webbing of about 20 millimeters in width in used. Preferably, the strap 30 has a length of less than about 5 inches, a width of less than about 2.5 inches, and a thickness of less than about 0.3 inches. Even more preferably, the strap 30 has a length of less than about 4 inches, a width of less than about 1.5 inches, and a thickness of less than about 0.2 inches.

Preferably, a pair of loops 31 and 33 are provided near the opposing ends of the strap 30 by doubling each edge 32 and 34 of the strap back toward the center of the strap, as is best shown in FIG. 3. The loops 31 and 33 receive a pair of D-rings 20 which allow the watch holder to be attached to an article. Stitching can be provided near the edges 32 and 34 of the strap 30 to form reliable and sturdy loops 31 and 33. Accordingly, once the strap 30 is secured to the base 10, the D-rings 20 extend from adjacent the oppositely disposed ends 11 and 13 of the base 10. As is known in the art, the D-rings 20 can have a pair of spaced ends to assist in attachment to the strap 30 and need not form a completed loop. In addition, it is contemplated that other types and shapes of rings could be used as alternatives to the D-rings 20 shown. Once secured to the holder, the D-rings 20 can then be attached to a variety of mechanisms on an article or person, such as the straps, clips, and other connection devices typically found on backpacks, duffle bags, and other pieces of luggage. It is also contemplated that the D-rings 20 allow the timepiece holder to simultaneously serve as a keychain for securing keys, key rings, and the like.

Figure 4:
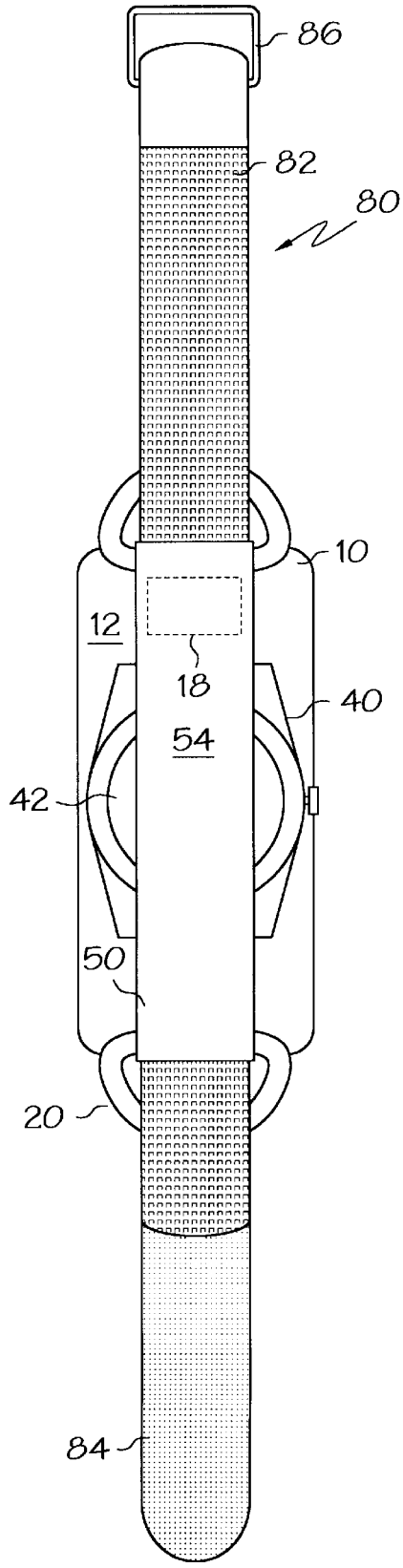
FIG. 4 is a front view of the watch holder and watch case of FIG. 1 showing the protective cover in a closed position, the holder being associated with a belt or strap for attachment to an article.

Alternatively, the rings 20 can be connected to additional attachment mechanisms which are in turn connected to the article. For example, as shown in FIG. 4, a belt or strap 80 can be fitted through the rings 20 and behind the base 10 for connecting the base to an article, such as a hat, helmet, suitcase, wrist, bicycle, or a coat arm for example. In addition the belt 80 could be used to secure the holder about the leg, forehead, or waist of the user. The belt 80 can be made in a variety of lengths to facilitate the connection to the desired article. For example, to attach the holder to the arm of a user and around the arm of a bulky coat, such as a ski coat, the belt 80 might be made between about 10 inches and about 20 inches in length, for example. To facilitate connection to a large suitcase, longer lengths would be desired. The belt 80 preferably comprises a loop connector portion 82 and a hook connector portion 84, for ease in connection of the device about the desired object or article. A buckle 86 can also be provided near one end to further facilitate in the connection. Accordingly, the D-rings 20 in conjunction with the belt 80 serve to connect the base 10 to an article. As an alternative to the belt 80, other connectors could be engaged with one or both of the D-rings 20, such as, for example, any of a variety of clips, buckles, straps, cords, chains, and strings. For example, a swivel clip, a carabiner clip, or a bungee cord strap could be used.

In a preferred embodiment as shown in FIGS. 1–5, a flexible band 50 is attached to the elastic strap 30 to serve as a cover to selectively shield at least a portion of the face 42 of the timepiece case 40 during use. The band 50 is preferably sturdy, resilient, and moisture and wear resistant to maximize the protective function. A variety of materials can be utilized for the band 50, such as a variety of nylons, fibers, natural and synthetic leathers, fabrics, plastics and cloths, for example. A nylon webbing about 25 millimeters wide is used in one preferred embodiment. Preferably, the band 50 has a length of less than about 5 inches, a width of less than about 2.5 inches, and a thickness of less than about 0.3 inches. Even more preferably, the band 50 has a length of less than about 4 inches, a width of less than about 1.5 inches, and a thickness of less than about 0.2 inches.

As best shown in FIG. 2 and FIG. 5, it is preferred that the band 50 is attached via "hook and loop" style connectors 38 and 16 to the strap 30 at the upper end of the strap. For example, "VELCRO" brand hook and loop connectors could be utilized. At the opposite and lower end of the strap 30, the band 50 is preferably connected to the strap by stitching. In this manner, the upper end of the band 50 is detachably engaged with the strap 30 by the "hook and loop" style connections and the lower end of the band is securely fastened to the strap by the stitching. Thus, in the embodiment shown in FIGS. 1–5, the band 50 is "indirectly" attached to the base 10 via another element—the strap 30 (i.e., the strap 30 is attached to the base 10 and the band 50 is attached to the strap). Accordingly, as used herein, words such as "attached", "secured", or "connected" should not be limited to meaning "directly" attached, secured, or connected, but should be interpreted to include both "direct" and "indirect" attachments, securements, or connections. As will be understood, while "hook and loop" style connections are mentioned to provide secure yet adjustable and "quick release" arrangements, other structures such as snaps, locks or other connector members can be substituted as desired.

As shown in FIG. 2 and FIG. 5, the watch case 40 typically includes a watch body 48, having a face side 42 and a rear side 44, and a pair of pins 46 detachably mounted near the ends of the watch body 48. In use, the watch case 40 can be placed such that the strap 30 extends over the pins 46 and behind the watch case 40 along the rear side 44. To place the watch case 40 in this secured position, the band 50 can be disengaged from the elastic strap 30 at the "hook and loop" connections 16 and 38 and moved to an open position, as shown in FIG. 1. Then, the pins 46 of the watch case 40 can be removed from the body 48 of the case, the body of the case placed on the strap 30, and the pins reattached to the case such that the strap enters the opening between the pins and the body.

Thus, because the strap 30 preferably fits through the openings in a wristwatch case, the elastic strap 30 is preferably of a width and thickness to fit through the opening of any standard wristwatch case. For example, the strap may have a thickness of less than about 0.3 inches and a width of less than about 2.5 inches. Even more preferably, the strap has a width of less than about 1.0 inches and a thickness of less than about 0.1 inches.

Once the watch case 40 is secured to the elastic strap 30, the band 50 can then be moved to a closed position by fastening the "hook and loop" connection 38 and 16 between the band 50 and the strap 30, as shown in FIG. 4 and FIG. 5. Thus, the "hook" attachment member 16 on the band 50 and the corresponding "loop" member 38 on the strap 30 serve as a locking mechanism to lock the protective cover in a closed position. Accordingly, when the band 50 is rotated to a closed or locked position, such as the position shown in FIG. 4 and FIG. 5, the inner surface 52 of the band 50 faces toward the front side 12 of the base 10 and the outer surface 54 faces away from the base 10. When in a closed position, the band 50 serves to protect and shield the face 42 of the watch case 40 from damage and exposure to moisture.

Once the watch case 40 is secured to the base by the elastic strap 30, the watch holder can in turn, then be attached to a portable article, such as a keychain, garment or a piece of luggage, for example, by using the rings 20 and/or the belt 80, as described above. Alternatively, the watch case 40 can be attached to the holder after the holder is secured to the article. When the watch case 40 has been attached to the holder and the holder attached to the article, it is preferred that the rear 44 of the watch case faces toward the front side 12 of the base 10 and the back side 14 of the base faces toward the article to which the holder is attached. Preferably, the holder is mounted to the article such that the back side 14 of the base 10 abuts the article and is snugly held thereto, to minimize the risk of removal and/or snagging any components during transportation. During use, the band 50 can be selectively moved to an open position to reveal the face 42 of the watch case 40 and allow for viewing the time displayed by the case, as well as to remove the watch case if desired.

Figure 6:
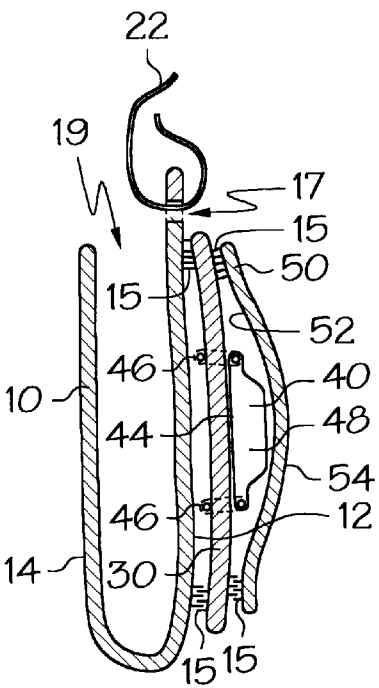
FIG. 6 is a cross sectional view of an alternate embodiment of the watch holder of the present invention, shown with a watch case secured to the holder and protected by the cover of the holder.

FIG. 6 is a cross sectional view of an alternative embodiment of the holder of the present invention. In this embodiment, the base 10 includes a pocket 19 formed between the back side 14 and the front side 12 of the base. Such a pocket allows the base to be additionally used for holding any of a variety of articles. The storage pocket could also include a closure or cover for holding loose items securely.

Moreover, in the exemplary embodiment of FIG. 6, the attachment mechanism is shown to comprise a cord 22 strung through a bore 17 in the base. This cord 22 can be used to attach the holder to the desired article, and can comprise any number of materials such as, for example, rubber, yarn, elastic, or leather. In this embodiment, the elastic strap 30 is attached to the base 10 by "hook and loop" connectors 15 near opposing ends of the length of the strap. Similarly, the band 50 is secured to the strap 30 by a pair of "hook and loop" connectors 15 near the upper and lower ends. Accordingly, in this embodiment, the strap 30 can be made completely detachable from the base 10, and the band 50 is completely detachable from the strap 30 by the "hook and loop" connectors 15. As in the embodiment of FIGS. 1–5, the watch case 40 is secured to the front side 12 of the base 10 by the strap 30. Also, like the exemplary embodiment described above, the elastic strap 30 is strung through the openings formed between the pins 46 and the watch body 48, and the outer side of the strap 30 faces the rear 44 of the watch case 40.

Figure 7:
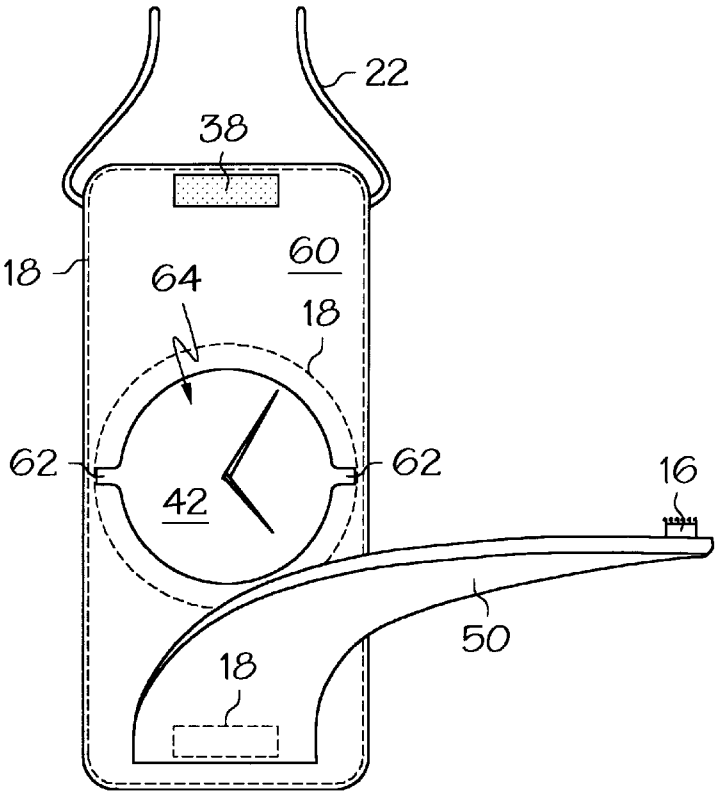
FIG. 7 is a front view of an additional exemplary embodiment of a watch holder made in accordance with the principles of the present invention, and shown with a watch case secured by an overlapping flexible patch.
Figure 8:
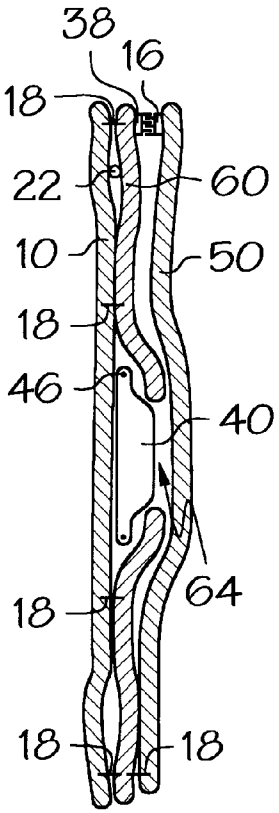
FIG. 8 is a cross sectional view of the watch holder of FIG. 7 taken along the longitudinal centerline.

FIG. 7 is a front view of an additional exemplary embodiment of a watch holder made in accordance with the present invention, and FIG. 8 is a cross sectional view of the embodiment of FIG. 7, taken along its longitudinal centerline. In this embodiment, the securement mechanism comprises a flat patch 60, similar in size and shape to the base 10, which is attached about the perimeter of the base by stitching 18. Alternatively, the patch 60 could be secured to the base 10 by other mechanisms, such as "hook and loop" style connections for example. The patch 60 includes an opening 64 through which the watch case 40 is inserted, and which has an effective diameter which is less than the effective diameter of the watch case with which the holder is used. In addition, a ring of stitching 18 is provided about the opening 64 to provide a slot, formed by a portion of the front side 12 of the base 10 and a portion of the inner side 61 of the patch 60. The watch case 40 sits securely in this slot, and the face of the watch case is displayed through the opening 64.

To aid in placing the watch case 40 through the opening 64, a pair of slits 62 are provided in the patch 60 and extending from the edges of the opening. Preferably, the patch 60 comprises a flexible material, such as leather for example, so that the portions of the patch near the slits 62 can be pulled outwardly when inserting the watch case 40 through the opening 64.

As is also shown in FIG. 7 and FIG. 8, a protective cover 50 is preferably attached to the patch 60 at one end by stitching 18 and at an opposite end by "hook and loop" connectors 38 and 16. Accordingly, the cover 50 can be moved away from the patch 60 at one end to an open position, such as is shown in FIG. 7, when it is desired to insert a watch case 40 into the holder, or when it is desired to view the time displayed by the watch case. When it is desired to cover the watch case 40, the cover 50 can then be moved to a closed position and reattached to the patch 60, as shown in FIG. 8. Preferably, the cover 50 comprises a flexible material, such as leather or nylon webbing for example.

Figure 9:
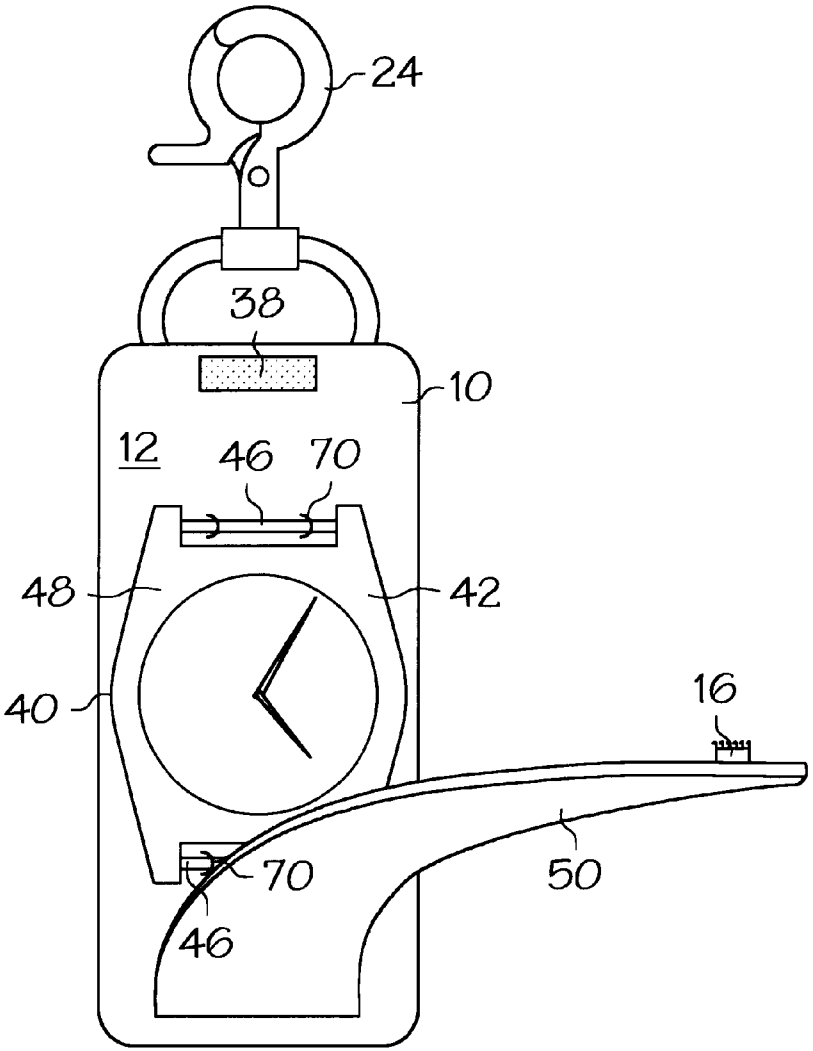
FIG. 9 is a front view of an additional exemplary embodiment of a watch holder according to the present invention, showing the protective cover in an open position and showing staple pins for securing the watch case to the holder.

FIG. 9 is a front view of an additional exemplary embodiment of a watch holder according to the present invention. In this embodiment, the attachment mechanism comprises a clip 24 which is attached near the back side of the base 10. The clip 24 can be manually deflected from a locked position to an unlocked position to attach the clip to an article, such as a backpack, keychain, or tent, for example.

In addition, in the embodiment of FIG. 9, the watch case 40 is secured to the front side of the base 10 by four staples or loops 70 which surround the pins 46 of the watch case. Preferably, the staples 70 pierce through the base 10 and are secured on the back side of the base 10, such as by placing caps on the staple ends or by tying or twisting the staple ends. It is also preferable that the ends of the staples 70 are sharp so as to easily pierce the base 10 at the locations where it is desire to secure the watch case 40. Accordingly, the base 10 preferably comprises an easily pierceable material, like leather or nylon for example. Once secured to the base 10 by the staples 70, the watch case 40 can be protected and shielded by the cover 50. Preferably, the cover 50 is selectively engaged with the base 10 by "hook and loop" connectors 38 and 16, which serve as a locking mechanism for maintaining the cover in the closed position.

Figure 10:
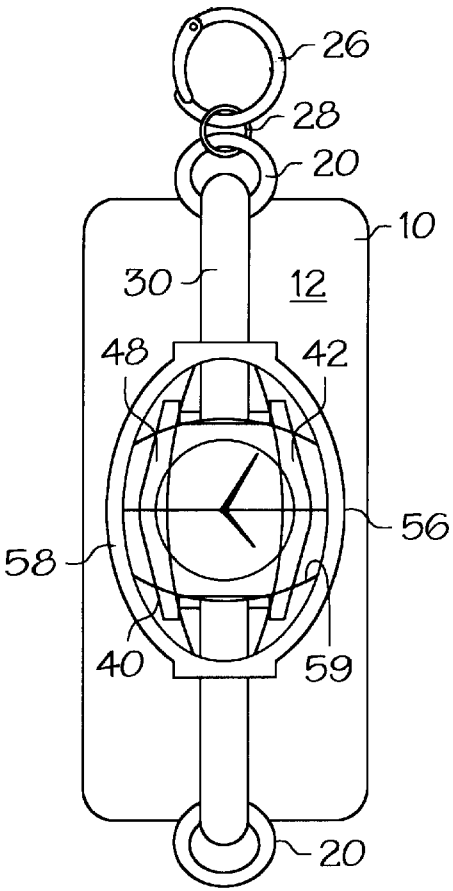
FIG. 10 is a front view of another exemplary embodiment of a watch holder according to the present invention, including a cage cover for protecting the watch case.

FIG. 10 is a front view of an additional exemplary embodiment of a watch holder made in accordance with the principles of the present invention. In this embodiment, the attachment mechanism comprises a pair of D-rings 20, a split key ring 28, and a carabiner 26. The split key ring 28 is attached to the upper D-ring 20, and the carabiner 26 is attached to the key ring. As is known in the art, the carabiner 26 can be attached to an article when in an unlocked position, such as the position shown in FIG. 10. Then the carabiner 26 can be moved to a locked position to connect the base 10 to the article.

In this embodiment, an elastic strap 30 is provided to secure the watch case 40 to the front side 12 of the base 10. As described above, the pins 46 of the watch case 40 can be removed and then reattached such that the strap 30 rests between the pins and the watch body, in order to secure the watch case to the base 10.

In addition, in the embodiment of FIG. 10, a relatively rigid protective cage 58 serves as a cover to shield and protect the watch case 40 from damage. The cage 58 preferably includes a plurality of bars 59 which cross over the watch case 40 to form a "skeletal" cover when the cage is in a closed position. Preferably, the cage 58 comprises a rigid material, such as a rigid plastic, carbon fiber, or metal for example. It is also preferred that one edge of the cage 58 is secured to the base 10 by a hinge mechanism or other arrangement so as to allow for the rotational opening and closing of the cage during use. Such "hingable" action would allow access to the timepiece for insertion or removal, maintenance or cleaning. Furthermore, it is preferred that another edge of the cage 58 is securable to the base 10 by a locking closure, such as a latch or a "hook and loop" connection for example, such that the cage can will remain in a closed position during use. The design of the cage itself could obviously be varied to accommodate a wide range of timepieces, applications and aesthetics.

Figure 11:
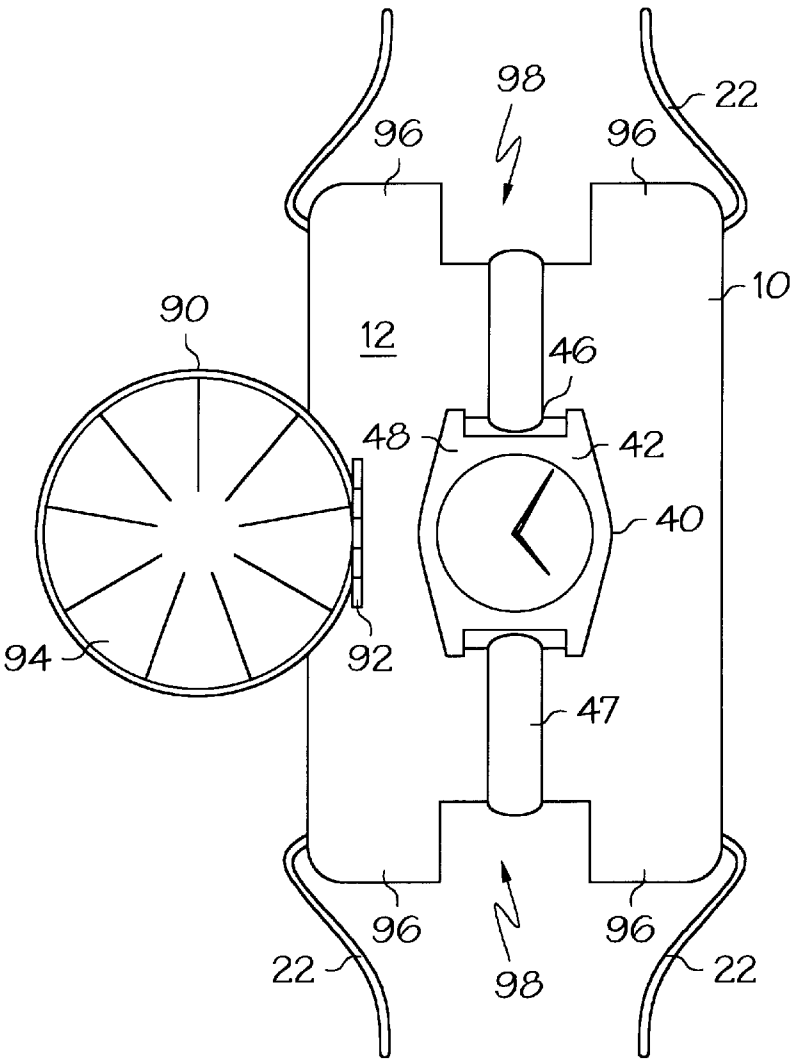
FIG. 11 is a front view of another exemplary embodiment of the watch holder of the present invention, showing the cover in an open position.

FIG. 11 is a front view of another exemplary watch holder made in accordance with the present invention. The watch holder comprises a base 10 having a front side 12 and a pair of recessed portions 98 formed at opposite ends of the base. In this embodiment, the entire wristwatch, including the watch case 40 and the watch band 47 which is connected to the watch case, is secured to the base 10 by wrapping the band about the recessed portions 98 of the base and securing the watch band at the back side of the base. The extended portions 96 of the base (which define the recessed portions 98) prevent the watch band 47 from sliding off of the base. Preferably, the recessed portions 98 are sufficiently wide to accommodate a variety of watch band widths Accordingly, the watch band 47 of the watch and the extended portions 96 of the base serve as securement mechanisms for securing the watch case to the front side 12 of the base.

In FIG. 11, a protective cover 90 is provided to shield the watch case 40 from damage. The protective cover 90 might comprise a shell or cup shaped hood which can preferably be moved from an open position, such as is shown in FIG. 11, to a closed position to cover at least a portion of the watch case 40. When the cover 90 is in a closed position, the inner surface 94 of the cover faces toward the face 42 of the watch case 40. As shown in FIG. 11, the cover 90 is attached to the base 10 by a hinge mechanism 92. The cover 90 is rotatable about the hinge mechanism 92 from an open position to a closed position (and vice versa). The hinge mechanism 92 can comprise, for example, a pin and bore arrangement, as known in the art, or a piece of flexible material which is secured to the cover 90 and the base 10. Once moved to a closed position, the cover 90 can be secured in the closed position by any of a variety of locking mechanisms, such as, by way of example, clasps, magnets, or "hook and loop" fasteners. A cord 22 is provided at opposing ends of the base 10 to connect the base to an article.

As can be understood, the timepiece holders described above allow a watch case to be securely fastened to an article such as a backpack or ski coat, while minimizing the risk of parts snagging during transportation. In addition, the holders can protect the watch case and can be used with a variety of watches that the user may have on hand.

The foregoing description of the preferred embodiments of the invention has been presented for purposes of illustration and description. It is not intended to be exhaustive or to limit the invention to the precise form disclosed, and modifications and variations are possible in light of the above teachings. For example, the use of "hook and loop" connectors in some of the embodiments has been described. However, it should be understood that a variety of other connectors could be used as alternatives, such as adhesives, buttons, locks, or stitches for example. Similarly, a number of materials and shapes have been described for use in the preferred embodiments of the present invention. However, it is to be understood that other materials and shapes could be used as alternatives to those described without departing from the scope of the invention. Likewise, a number of securement mechanisms have been described for securing the base to the watch case (such as straps, patches, and staple pins), and a number of attachment mechanisms have been described for securing the base to an article (such as rings, clips, and belts). However it is contemplated that other securement mechanisms and attachment mechanisms could be used without departing from the scope of the invention. Similarly, although the cover has been described as comprising a flexible band or a rigid cage, it is contemplated that the cover could comprise a shell, enclosure, or casing which is movable from an open to a closed position, such as by a hinge.

Thus, it should be understood that the embodiments were chosen and described in order to best illustrate the principals of the invention and its practical application to thereby enable one of ordinary skill in the art to best utilize the invention in various embodiments and with various modifications as are suited for the particular use contemplated. Accordingly, it is intended that the scope of the invention be defined by the claims appended hereto.

What is claimed is:

1. A protective holder for a timepiece, comprising:

a base;

a strap attached to the base and adapted to secure the timepiece to the base;

a cover attached to the base and having at least a part of which can be selectively moved between an open position in which visual access to the timepiece is provided, and a closed position in which at least a portion of the timepiece is shielded; and an attachment mechanism comprising a first ring attached to the base and adapted to connect the base to an article.

2. The protective holder as recited in claim 1, wherein the base has oppositely disposed first and second ends, the first ring is attached near the first end of the base, and the attachment mechanism further comprises:

a second ring attached near the second end of the base; and a belt fitted through the first and second rings.

3. The protective holder as recited in claim 1, wherein the strap has a width of less than about 2.5 inches in at least one location and a thickness of less than about 0.3 inches in at least one location.

4. The protective holder as recited in claim 1, wherein the base includes a front side and a back side, and wherein the strap is at least partially flexible and overlies a portion of the front side of the base.

5. The protective holder as recited in claim 1, wherein the strap is attached to the base at two locations, and wherein the strap includes an unattached portion between the two locations.

6. The protective holder as recited in claim 1, further comprising:

a lock mechanism attached to the base and adapted to lock the cover in the closed position.

7. The protective holder as recited in claim 1, wherein the cover comprises a flexible band.

8. The protective holder as recited in claim 1, wherein the cover comprises a plurality of rigid bars.

9. The protective holder as recited in claim 1, wherein the cover has an inner surface and an outer surface, the base includes a front side and a back side, the inner surface of the cover is adapted to face toward the front side of the base when the cover is in the closed position, and the outer surface of the cover is adapted to face away from the base when the cover is in the closed position.

10. The protective holder as recited in claim 8, wherein the strap is at least partially flexible and extends over a portion of the front side of the base, the strap has a minimum width of less than about 2.5 inches and a minimum thickness of less than about 0.3 inches, the strap is secured to the base at two locations and includes an unattached portion between the two locations, and the protective cover comprises a band which overlies at least a portion of the strap when the band is in the closed position.

11. A holder for securing a watch case to an article, the holder comprising:

a base having a front side and a back side;

an attachment mechanism comprising a first ring, wherein the first ring is attached to the base and adapted to connect the base to an article by a connector configured to engage the first ring;

a securement mechanism;

a watch case having a face and a rear, wherein the watch case is secured on the front side of the base by the securement mechanism such that the face of the watch case faces away from the front side of the base and the rear faces toward the front side of the base; and a cover attached to the base and having at least a part of which can be selectively moved between an open position in which visual access to the watch case is provided, and a closed position in which at least a portion of the watch case is shielded.

12. The holder as recited in claim 11, wherein the securement mechanism comprises a flexible strap having a width of less than about 2.5 inches in at least one location and a thickness of less than about 0.3 inches in at least one location.

13. The protective holder as recited in claim 11, wherein the cover comprises a flexible band.

14. The protective holder as recited in claim 11, wherein the base comprises a generally flat section of flexible material.

15. A protective holder for a timepiece, comprising:

a base;

a securement mechanism attached to the base and adapted to secure the timepiece to the base;

a cover attached to the base and having at least a part of which can be selectively moved between an open position in which visual access to the timepiece is provided, and a closed position in which at least a portion of the timepiece is shielded; and an attachment mechanism comprising a first ring attached to the base and adapted to connect the base to an article of manufacture.

16. The protective holder as recited in claim 15, wherein the first ring comprises a D-ring.

17. A protective holder for a timepiece, comprising:

a base;

a securement mechanism attached to the base and adapted to secure the timepiece to the base;

a cover attached to the base and having at least a part of which can be selectively moved between an open position in which visual access to the timepiece is provided, and a closed position in which at least a portion of the timepiece is shielded; and an attachment mechanism comprising a piece separate from the base and attached to the base, wherein the attachment mechanism is adapted to connect the base to an article of manufacture.

* * * * *